US006475642B1

(12) United States Patent
Zhao et al.

(10) Patent No.: US 6,475,642 B1
(45) Date of Patent: Nov. 5, 2002

(54) OXIDATION-RESISTANT COATINGS, AND RELATED ARTICLES AND PROCESSES

(75) Inventors: Ji-Cheng Zhao, Niskayuna, NY (US); Melvin Robert Jackson, Niskayuna, NY (US); Ramgopal Darolia, West Chester, OH (US)

(73) Assignee: General Electric Company, Niskayuna, NY (US)

( * ) Notice: Subject to any disclaimer, the term of this patent is extended or adjusted under 35 U.S.C. 154(b) by 73 days.

(21) Appl. No.: 09/651,968

(22) Filed: Aug. 31, 2000

(51) Int. Cl.[7] ..... B32B 15/01; B32B 31/00; C22C 38/06

(52) U.S. Cl. ..... 428/636; 148/516; 148/527; 148/535; 148/325; 148/333; 148/425; 148/426; 148/428; 148/429; 148/442; 420/35; 420/63; 420/68; 420/69; 420/70; 420/77; 420/80; 420/96; 420/104; 420/110; 420/127; 420/437; 420/447; 420/448; 420/460; 420/551; 420/552; 420/580; 420/632; 420/637; 420/650; 420/652; 420/678; 420/469; 420/472; 428/680; 428/681

(58) Field of Search ..... 428/632, 636, 428/637, 650, 678, 652, 469, 472, 680, 681; 148/516, 527, 535, 325, 333, 425, 426, 428, 429, 442; 420/34, 35, 62, 63, 67, 68, 69, 70, 77, 79, 80, 81, 96, 97, 104, 105, 110, 124, 127, 437, 438, 447, 448, 460, 551, 552, 580

(56) References Cited

U.S. PATENT DOCUMENTS 5,432,011 A * 7/1995 DuBois et al. ..... 428/650
5,455,119 A * 10/1995 Taylor et al. ..... 428/632

FOREIGN PATENT DOCUMENTS

DE 19941228 A1 * 3/2001 ..... C23C/30/00

* cited by examiner

*Primary Examiner*—Robert R. Koehler
(74) *Attorney, Agent, or Firm*—Paul J. DiConza; Patrick K. Patnode

(57) ABSTRACT

An oxidation-resistant coating is described, formed of an alloy containing: about 40 to about 50 atom % aluminum and about 0.5 atom % to about 3 atom % tantalum; with a balance of nickel; cobalt, iron, or combinations thereof. The coating may also include chromium and a precious metal, as well as other components, such as zirconium or molybdenum. A method for applying the oxidation-resistant coating to a substrate is also described. The substrate can be formed of superalloy material, e.g., a turbine engine component. Related articles are also disclosed.

45 Claims, 2 Drawing Sheets

OXIDATION-RESISTANT COATINGS, AND RELATED ARTICLES AND PROCESSES

BACKGROUND OF THE INVENTION

In a general sense, this invention relates to protective coatings applied to metals. More specifically, it relates to metallic coatings which provide oxidation resistance and other attributes to various metal substrates used at high temperatures, e.g., superalloy substrates.

Metal alloys are often used in industrial environments which include extreme operating conditions. For example, the alloys may be exposed to high temperatures, e.g., above about 750° C. Moreover, the alloys may be subjected to repeated temperature cycling, e.g., exposure to high temperatures, followed by cooling to room temperature, and then followed by rapid re-heating. As an example, gas turbine engines are often subjected to repeated thermal cycling during operation. Furthermore, the standard operating temperature of turbine engines continues to be increased, to achieve improved fuel efficiency.

The turbine engine components (and other industrial parts) are often formed of superalloys, which are usually nickel-, cobalt-, or iron-based. Superalloys can withstand a variety of extreme operating conditions. However, they often must be covered with coatings which protect them from environmental degradation, e.g., the adverse effects of corrosion and oxidation.

Various types of coatings are used to protect superalloys and other types of high-performance metals. One type is based on a material like MCrAlY, where M is iron, nickel, cobalt, or various combinations thereof. These materials can be applied by many techniques, such as high velocity oxy-fuel (HVOF); plasma spray, or electron beam vapor deposition (EB-PVD). Another type of protective coating is an aluminide material, such as nickel-aluminide or platinum-nickel-aluminide. Many techniques can be used to apply these coatings as well. For example, platinum can be electroplated onto the substrate, followed by a diffusion step, which is then followed by an aluminiding step, such as pack aluminiding.

Regardless of coating method, the trend toward higher operating temperatures continues to increase the propensity for corrosion and oxidative attack of the coatings and the underlying metal substrate. Thus, new coating compositions for metal substrates—especially superalloy substrates—would be welcome in the art. The compositions should generally provide better oxidation resistance than currently-used coatings—especially at use temperatures greater than about 1000° C., and preferably, greater than about 1100° C. Moreover, the oxidation resistance should generally be maintained when the coated substrate is subjected to a considerable level of thermal cycling, as discussed below.

The new compositions should also be capable of being applied by techniques currently available in the art. Furthermore, the compositions should be based on components that can be varied (in type or amount) to suit specific end uses. For example, the compositions should not require the inclusion of costly components at high levels, for a fairly broad spectrum of applications. Finally, other properties for the new compositions should generally be maintained at acceptable levels, e.g., properties such as corrosion resistance and ductility.

SUMMARY OF THE INVENTION

One primary embodiment of the present invention is directed to an oxidation-resistant coating, formed of an alloy comprising:

about 30 to about 55 atom % aluminum; and about 0.5 atom % to about 3 atom % tantalum;

with the balance comprising at least one base metal selected from the group consisting of nickel, cobalt, iron, and combinations thereof.

In certain preferred embodiments, the alloy also includes a precious metal such as platinum or palladium. Moreover, the alloy often contains chromium. The chromium can be obtained from an underlying substrate by way of diffusion, and/or it can be included as part of the deposited alloy composition. In the same manner, the base metal can diffuse from the substrate, or can be included as part of the deposited alloy.

Some of the embodiments described below also include other elements in the alloy composition. Examples include zirconium, titanium, hafnium, silicon, boron, carbon, yttrium, and combinations thereof. Zirconium is especially preferred for some embodiments. Moreover, other compositions within the scope of this invention advantageously include molybdenum.

As described below, some end use applications for the present invention benefit from a lower level of aluminum, i.e., about 30 atom % to about 45 atom %. Other end use applications utilize a higher level of aluminum, i.e., about 45 atom % to about 55 atom %. In either case, the alloy compositions may include some or all of the other components mentioned above, and further described in this specification.

Another embodiment of this invention is directed to a method for providing environmental protection to a metal-based substrate, such as a superalloy surface. In this method, the alloy composition described above is applied to the substrate, absent any components (e.g., nickel or chromium) which will be incorporated into the composition from the substrate itself. Conventional techniques are used to apply the coating, as described below. Single-stage or multiple-stage processes may be used.

Still another embodiment of this invention is directed to an article, comprising:

(i) a metal-based substrate; and (ii) an oxidation-resistant coating over the substrate, formed of the alloy outlined above and further described below. In some instances, the oxidation-resistant coating is covered with a thermal barrier coating. The substrate is often a superalloy, and can be a component of a turbine engine.

In this description of the invention, alloy components for the oxidation-resistant coating are advantageously expressed in "atom percent". Conversion of these values to "weight percent" can easily be carried out, using the atomic weights for each element. As an example for the aluminum/tantalum/base metal composition described above, "about 30 to about 55 atom % aluminum" corresponds to about 15 to about 35.5 weight percent aluminum. The range of "about 0.5 atom % to about 3 atom % tantalum" corresponds to about 2.2 to about 10.3 weight percent tantalum. (The balance is nickel or another base metal, as discussed below). Similarly, for a three-component alloy, using platinum as the exemplary precious metal, the approximate ranges are as follows:

| | | |
|---|---|---|
| 1) Aluminum | Atom % Range<br>30–55 | Weight % Range<br>12.2–34.4 |
| 2) Tantalum | Atom % Range<br>0.5–3 | Weight % Range<br>2.1–10.0 |

-continued

| 3) Precious Metal (Platinum) | Atom % Range | Weight % Range |
|---|---|---|
| | 1–10 | 4.5–29.3 |

Again, the balance is the base metal.

In the case of an Al/Ta/Cr alloy system, the following conversion-table is helpful (with the balance being the base metal):

| | | |
|---|---|---|
| 1) Aluminum | Atom % Range 30–55 | Weight % Range 15–35.5 |
| 2) Tantalum | Atom % Range 0.5–3 | Weight % Range 1.8–10.4 |
| 3) Chromium | Atom % Range 1–10 | Weight % Range 1.2–10.6 |

Several other range-conversions are provided below, for some of the preferred embodiments of this invention. Other details regarding the various features of this invention are found in the remainder of the specification.

DETAILED DESCRIPTION OF THE INVENTION

Figure 1:
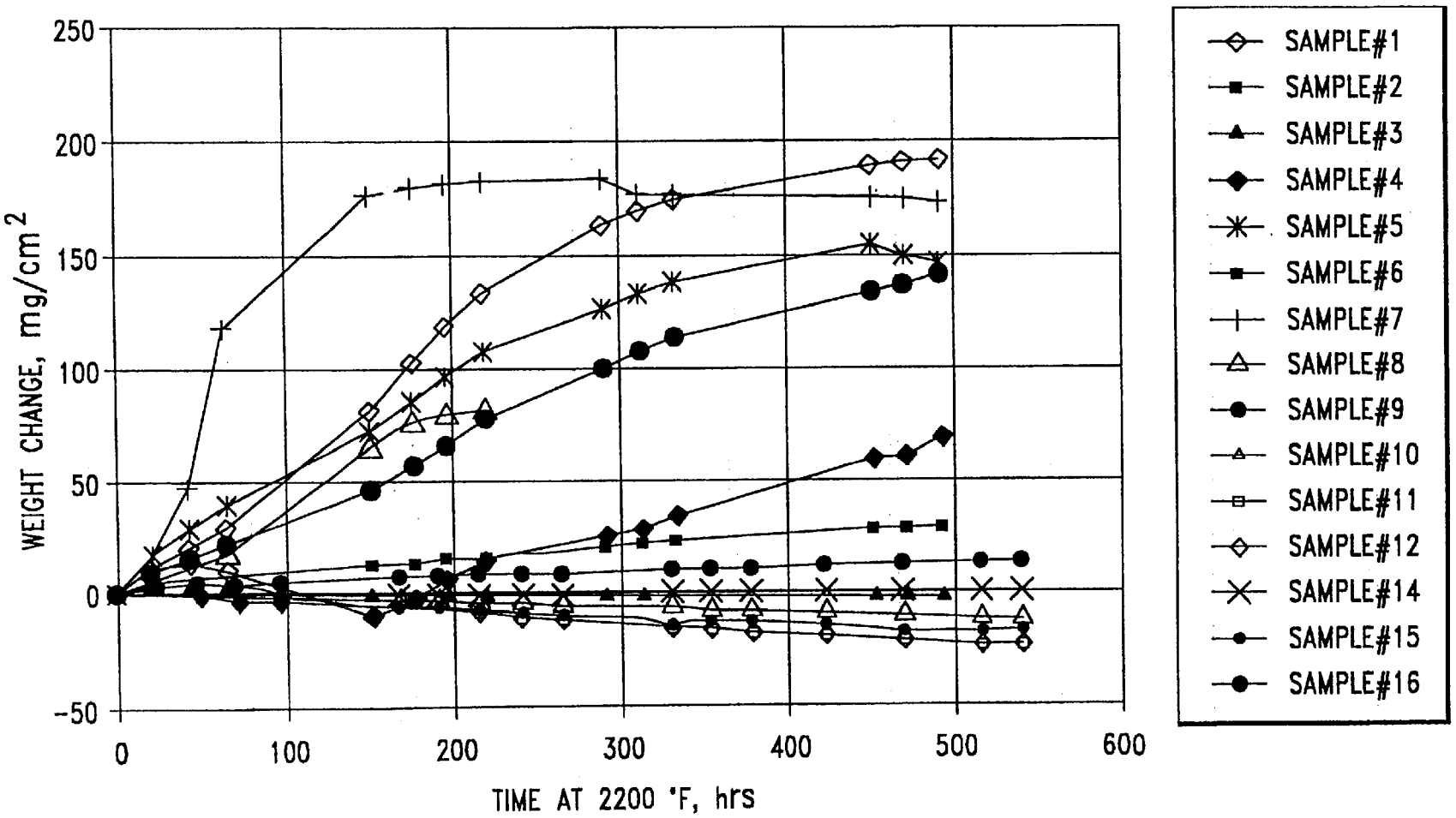
FIG. 1 is a graph of oxidation resistance data for various alloy samples, within and outside the scope of this invention.

As mentioned above, one embodiment of this invention embraces a coating formed from an alloy comprising:

about 30 to about 55 atom % aluminum; and about 0.5 atom % to about 3 atom % tantalum. The balance (sometimes referred to herein as the "base metal") comprises nickel, cobalt, iron, or combinations thereof.

A preferred level of aluminum for some embodiments is about 35 atom % to about 55 atom %. A preferred level of tantalum is about 0.5 atom % to about 2 atom %. In some especially preferred embodiments, the aluminum is present at a level in the range of about 40 atom % to about 50 atom %; and the tantalum is present at a level in the range of about 0.75 atom % to about 1.75 atom %. In many embodiments, the balance is preferably nickel, or a combination of nickel and cobalt, e.g., a nickel/cobalt ratio (by atom percent) in the range of about 99:1 to about 50:50.

In some instances, the source of nickel or the other base metals is the substrate over which the coating is applied. Substrates made from high temperature alloys (e.g., the superalloys) contain one or more of these metals. When the surface of such a substrate is brought into contact with the coating at elevated temperatures (e.g., above about 900° C.), substantial diffusion (i.e., migration) of the base metal from the substrate into the coating occurs. It should also be noted that the present invention contemplates that a portion of the base metal may be included in the coating as it is deposited, while another portion diffuses into the coating from the substrate. The base metal may also diffuse into the coating from the substrate when the component is in use, as discussed below in reference to chromium migration.

Coatings of this type (i.e., without chromium) have a level of oxidation resistance and ductility which is suitable for certain end use applications. For example, the coatings are sometimes useful for applications which do not involve a great deal of exposure at temperatures greater than about 1100° C., or which do not call for a considerable amount of temperature cycling. Those skilled in the metallurgical arts are able to determine if such coatings meet the requirement for a particular application, using conventional evaluation techniques.

These alloys sometimes contain at least one precious metal, which often provides greater oxidation resistance for the coatings . Examples include platinum, palladium, iridium, rhodium, ruthenium, and mixtures thereof. Selection of a particular precious metal will depend on various factors, such as cost, availability, ductility requirements, and oxidation resistance requirements. Platinum, palladium, and ruthenium are the preferred precious metals, with platinum often being most preferred. The a mount of precious metal employed will depend on the factors noted above, as well as other considerations, e.g., the solubility of the precious metal in the aluminide phase. Very often, platinum is used at a level in the range of about 1 atom % to about 10 atom %. The other precious metals may be present at a level in the range of about 1 atom % to about 30 atom %.

In some preferred embodiments, these alloys include relatively minor amounts of other elements. For example, they may include at least one component selected from the group consisting of zirconium, titanium, hafnium, silicon, boron, carbon, and yttrium. The total amount of these other elements is usually in the range of about 0.1 atom % to about 5 atom %, and preferably, in the range of about 0.4 atom % to about 2.5 atom %. A preferred group of these additional elements is zirconium, hafnium, silicon, yttrium, and various mixtures thereof. In many instances, the inclusion of these additional elements further enhances oxidation resistance and related properties, e.g., anti-spallation characteristics. Zirconium or hafnium is especially preferred in some embodiments. They are usually employed at individual levels in the range of about 0.1 atom % to about 1 atom %, and preferably, about 0.2 atom % to about 0.8 atom %.

In other preferred embodiments of the present invention, the alloy composition includes molybdenum. The present inventors discovered that the presence of this element resulted in unexpectedly good oxidation resistance—even when relatively low levels of aluminum were included. Thus, one illustrative alloy of this type comprises aluminum, tantalum, and molybdenum, along with the base metal. The level of molybdenum is usually in the range of 0.2 atom % to about 2 atom %. Very often, preferred levels of molybdenum are in the range of about 0.5 atom % to about 1.5 atom %. In some especially preferred embodiments, this alloy would also contain at least one precious metal, as described previously.

In many preferred embodiments, the compositions described above comprise about 1 atom % to about 15 atom % chromium. Very often, the presence of chromium enhances the oxidation resistance and hot corrosion resistance of the coating. In many instances, the use of chromium decreases the need (or decreases the preferred level) of other optional components which provide these beneficial characteristics. For example, coating compositions which include chromium may only use relatively small amounts of more expensive elements, such as platinum or palladium, while achieving substantially the same level of oxidation resistance and corrosion resistance.

Many of these chromium-containing coating systems comprise:

about 30 to about 55 atom % aluminum;

about 0.5 atom % to about 3 atom % tantalum;

about 1 atom % to about 15 atom % chromium;

with the balance comprising nickel, cobalt, iron, or combinations thereof. A preferred level of chromium is often in the range of about 1 atom % to about 10 atom %.

As in the case of the base metal, the source of chromium is sometimes the substrate. Substrates made from high temperature alloys (e.g., the superalloys) usually contain chromium. When the surface of such a substrate is brought into contact with the coating at elevated temperatures (e.g., above about 900° C.), substantial diffusion (i.e., migration) of chromium into the coating occurs. Thus, diffusion can occur in different ways. For example, an aluminiding process used to apply the coating to the substrate at elevated temperatures can result in migration of the chromium from the surface region into the coating. Alternatively (or in addition to such deposition), a subsequent heat treatment of the coated substrate will usually result in chromium migration.

Moreover, if the chromium-containing substrate is a component which will be subjected to high temperatures during operation (e.g., a turbine engine component), these use-temperatures will cause the chromium to diffuse into the coating. It should also be noted that the present invention contemplates that a portion of the chromium may be included in the coating as it is deposited, while another portion diffuses into the coating from the substrate. The amount of chromium in the coating can be determined by techniques known in the art, e.g., electron probe microanalysis; X-ray fluorescence techniques; or atomic absorption spectroscopy.

A preferred level of aluminum for the chromium-containing compositions is usually about 35 atom % to about 55 atom %, although several different aluminum-variable embodiments are noted below. Preferred levels of tantalum are as noted above, along with a discussion of a preferred base metal, e.g., nickel or nickel-cobalt. Moreover, the chromium-containing embodiments may include at least one precious metal, as discussed previously in relation to the other embodiments.

The following conversion table is given for an exemplary Al/Ta/Cr/Pt alloy system (with the base metal as the balance):

| | | |
|---|---|---|
| 1) Aluminum | Atom % Range 30–55 | Weight % Range 12.2–34.4 |
| 2) Tantalum | Atom % Range 0.5–3 | Weight % Range 2.1–10.1 |
| 3) Chromium | Atom % Range 1–10 | Weight % Range 1.2–9.7 |
| 4) Platinum | Atom % Range 1–10 | Weight % Range 3.6–29.6 |

The chromium-containing embodiments may also contain the other elements described previously, e.g., zirconium, titanium, hafnium, silicon, boron, carbon, yttrium, and various mixtures thereof. Selection of a particular element or combination of elements depends on the desired attributes for the coating, as well as the other factors set forth above. Suggested levels for these elements have also been provided previously.

In some of the chromium-containing embodiments (as in other embodiments), the inclusion of zirconium is especially preferred. Usually, zirconium is present at levels in the range of about 0.1 atom % to about 1 atom %, and preferably, about 0.2 atom % to about 0.8 atom %. As the examples below demonstrate, the presence of zirconium often improves oxidation resistance, while significantly reducing thermally-grown oxide (TGO) growth. In some instances, a precious metal is also present in the zirconium-containing alloys, as shown in the examples.

The following conversion table is given for an exemplary Al/Ta/Cr/Zr alloy system (base metal as balance):

| | | |
|---|---|---|
| 1) Aluminum | Atom % Range 30–55 | Weight % Range 15.2–35.7 |
| 2) Tantalum | Atom % Range 0.5–3 | Weight % Range 1.8–10.4 |
| 3) Chromium | Atom % Range 1–10 | Weight % Range 1.2–10.5 |
| 4) Zirconium | Atom % Range 0.1–1 | Weight % Range 0.2–2.1 |

Some of the chromium-containing embodiments advantageously include molybdenum. Molybdenum provides the performance advantages described above, and in the examples. The molybdenum is usually present at the levels set forth previously.

As alluded to earlier, different applications for the coating compositions of this invention may benefit from different levels of aluminum, within the broad range set forth above. In some applications which require a high degree of oxidation resistance, a higher aluminum level in a coating is desirable, e.g., a level in the range of about 45 to about 55 atom %.

However, in other applications, higher aluminum levels sometimes consume an excessive portion of the substrate material, e.g., in the case of the wall of a turbine airfoil. This phenomenon appears to occur when aluminum migrates from the coating into the substrate at elevated temperatures, forming a diffusion zone in the interfacial area. In such an instance, a lower aluminum level may be desirable, such as about 30 to about 45 atom %. The lower level appears to result in a smaller reservoir in the initial coating for migration, while still providing good oxidation resistance. Those skilled in the art will be able to select the most appropriate level of aluminum for a given end use, based on the teachings herein.

Another embodiment of this invention is directed to a method for providing environmental protection to a metal-based substrate, As used herein, "environmental protection" refers to protection of a metal substrate from various adverse effects, e.g., oxidation and corrosion. The method comprises:

forming a coating on the substrate, having an alloy composition which comprises:

about 30 to about 55 atom % aluminum; and about 0.5 atom % to about 3 atom % tantalum;

with the balance comprising a base metal selected from the group consisting of nickel; cobalt, iron, and combinations thereof. As noted above, the base metal can be obtained from the underlying substrate by diffusion. Thus, as used herein, "forming a coating on a substrate" is meant to include the deposition of the entire coating material, as well as the deposition of a portion of the coating material, followed by diffusion of the remaining components from the substrate into the deposited coating.

As described previously, the coating alloy often contains chromium, e.g., at a level in the range of about 1 atom % to about 15 atom %. Alternatively, a portion (or the total amount) of chromium can be incorporated into the coating from the substrate, by diffusion. The alloy may also contain at least one precious metal, as discussed previously. One or more other elements may be incorporated into the alloy in minor amounts, e.g., zirconium, titanium, hafnium, silicon, boron, carbon, and yttrium. Furthermore, some of the preferred embodiments include molybdenum in the coating alloy.

Many different metals or metal alloys can be used as the substrate for the present invention. The term "metal-based" refers to those which are primarily formed of metal or metal alloys, but which may also include some non-metallic components, e.g., ceramics, intermetallic phases, or intermediate phases. Usually, the substrate is a heat-resistant alloy, e.g., superalloys which typically have an operating temperature of up to about 1000–1150° C. (The term "superalloy" is usually intended to embrace complex cobalt- or nickel-based alloys which include one or more other elements, such as rhenium, aluminum, tungsten, molybdenum, titanium, or iron.)

Superalloys are described in various references, such as U.S. Pat. Nos. 5,399,313 and 4,116,723, both incorporated herein by reference. High temperature alloys are also generally described in Kirk-Othmer's *Encyclopedia of Chemical Technology,* 3rd Edition, Vol. 12, pp. 417–479 (1980), and Vol. 15, pp. 787–800 (1981). Nickel-base superalloys typically include at least about 40 wt % Ni. Illustrative alloys are designated by the trade names Inconel®, Nimonic®, Rene® (e.g., Rene®80, Rene®95 alloys), and Udimet®. Cobalt-base superalloys typically include at least about 30 wt % Co. Commercial examples are designated by the trade names Haynes®, Nozzaloy®, Stellite®, and Ultimet®. The actual configuration of a substrate may vary widely. For example, the substrate may be in the form of various turbine engine parts, such as combustor liners, combustor domes, shrouds, buckets, blades, nozzles, or vanes.

Methods for applying the coatings are known in the art. They include, for example, electron beam physical vapor deposition (EB-PVD); electroplating, ion plasma deposition (IPD); low pressure plasma spray (LPPS); chemical vapor deposition (CVD), plasma spray (e.g., air plasma spray (APS)), high velocity oxy-fuel (HVOF), and the like. Very often, single-stage processes can deposit the entire coating chemistry. For example, the elements can be combined by various techniques, such as induction melting, followed by powder atomization. Melt-type techniques for this purpose are known in the art, e.g., U.S. Pat. No. 4,200,459, which is incorporated herein by reference. Those skilled in the art can adapt the present invention to various types of equipment. For example, the alloy coating elements could be incorporated into a target in the case of ion plasma deposition.

Multiple stages of deposition can alternatively be employed. As an example, a precious metal like platinum is usually applied by a technique that reduces waste, e.g., a direct deposition method like electroplating. As a non-limiting illustration, the precious metal can be electroplated onto the substrate surface, followed by the thermal deposition (e.g., by HVOF) of a powder composition of nickel, tantalum, and other included elements. Aluminiding can then be carried out, to help ensure good intermixing of the precious metal with the rest of the coating composition. As alluded to earlier, various aluminiding procedures are available.

Sometimes, a heat treatment is performed after the deposition of the coating. Exemplary treatments for homogenization and/or interdiffusional bonding include hydrogen-, argon-, or vacuum-heat treatments. The treatment is often carried out at a temperature in the range of about 950° C. to about 1200° C., for up to about 10 hours.

In some embodiments of this invention, a thermal barrier coating (TBC) can be applied over the oxidation-resistant coating. TBC's provide a higher level of heat resistance when the article is to be exposed to very high temperatures. For example, they are frequently used in environments in which the TBC surface may be exposed to temperatures greater than about 1300° C., while the underlying coating is exposed to a temperature of about 1100° C. TBC's are often used as overlayers for turbine blades and vanes. In addition to its function in providing oxidation-and corrosion resistance, the coating described above often promotes adhesion between the TBC and the substrate.

The TBC is usually (but not always) zirconia-based. As used herein, "zirconia-based" embraces ceramic materials which contain at least about 70% zirconia, by weight. In preferred embodiments, the zirconia is chemically stabilized by being blended with a material such as yttrium oxide (yttria), calcium oxide, magnesium oxide, cerium oxide, scandium oxide, or mixtures of any of those materials. In one specific example, zirconia can be blended with about 1% by weight to about 20% by weight yttrium oxide (based on their combined weight), and preferably, from about 3%–10% yttrium oxide.

A number of techniques can be used to apply the TBC. Very often, an EB-PVD technique is used. In some instances, a plasma spray technique is used, such as air plasma spray (APS). Those skilled in the art are familiar with the operation details for employing each of these techniques.

Still another embodiment of this invention is directed to an article. The article includes the metal-based substrate, as described previously. An oxidation-resistant coating is disposed over the substrate, formed of an alloy which comprises:

about 30 to about 55 atom % aluminum; and about 0.5 atom % to about 3 atom % tantalum;

with the balance comprising nickel, cobalt, iron, or combinations thereof.

As described previously, the alloy often contains chromium, e.g., at a level in the range of about 1 atom % to about 15 atom %, which may be incorporated therein via diffusion from the substrate. The alloy may also contain at least one precious metal such as platinum, as discussed previously (with or without the chromium component). One or more other elements may be incorporated into the alloy in minor amounts, e.g., zirconium, titanium, hafnium, silicon, boron, carbon, and yttrium. As also described above, molybdenum is often incorporated into the alloy according to this invention.

The thickness of the oxidation-resistant coating will depend on a variety of factors. Illustrative considerations include: the particular composition of the coating and the substrate; the intended end use for the coating; the expected temperature and temperature patterns to which the article itself will be subjected; the presence or absence of an overlying TBC; and the desired service life of the coating. When used for a turbine engine application, the coating usually has a thickness (including any diffusion region) in the range of about 20 microns to about 200 microns, and most often, in the range of about 25 microns to about 100 microns. It should be noted, though, that these ranges may be varied considerably to suit the needs of a particular end use.

It should also be apparent that another embodiment of this invention includes an article as described above, in which the oxidation-resistant coating is covered by a TBC. As described previously, the TBC is often (but not always) formed from chemically-stabilized zirconia. The thickness of the TBC will depend on many of the factors set forth above. Usually, its thickness will be in the range of about 75 microns to about 1300 microns. In preferred embodiments for end uses such as turbine engine airfoil components, the thickness is often in the range of about 75 microns to about 300 microns.

EXAMPLES

The following examples are merely illustrative, and should not be construed to be any sort of limitation on the scope of the claimed invention.

The alloys listed in the table below were prepared by vacuum induction-melting. Test coupons were machined from the resulting cast ingots. Isothermal oxidation was performed at 1200° C. for up to 518 hours, as shown in the figures. The weight change of the test coupons was recorded and employed as a measurement of oxidation resistance. Alloys with the lowest weight gain had the best oxidation resistance. When oxide spallation occurred, a negative weight change was indicated in the weight change-versus-time curve.

TABLE

| Sample # | Base | Pt* | Al | Ta | Cr | Zr | Mo | Other Elements/ Comments |
|---|---|---|---|---|---|---|---|---|
| 1 | Ni | 8 | 38 | 1 | | | | 1% Re |
| 2 | Ni | 8 | 50 | | | | | |
| 3 | Ni | 8 | 38 | 1 | | | 1 | |
| 4 | Ni | 8 | 50 | | | | 1 | 1% Re |
| 5 | Ni | 8 | 38 | | | | | 1% Re, 1% W |
| 6 | Ni | 8 | 50 | 1 | | | | 1% W |
| 7 | Ni | 8 | 38 | | | | 1 | 1% W |
| 8 | Ni | 8 | 50 | 1 | | | 1 | 1% Re, 1% W |
| 9 | Ni | 8 | 38 | | | | | |
| 10 | Ni | | 38 | 1 | 5 | 0.2 | | |
| 11 | Ni | | 50 | 1 | 5 | | | |
| 12 | Ni | | 38 | 1.8 | 5 | | | |
| 13 | Ni | | 50 | 1.8 | 5 | 0.2 | | |
| 15 | Ni | 8 | 38 | 1 | 5 | | | |
| 16 | Ni | 8 | 38 | | 5 | 0.2 | | |
| 17 | Ni | 8 | 50 | 1 | | | 1 | |

Notes: *All amounts are listed in atom %, unless otherwise indicated.

Figure 2:
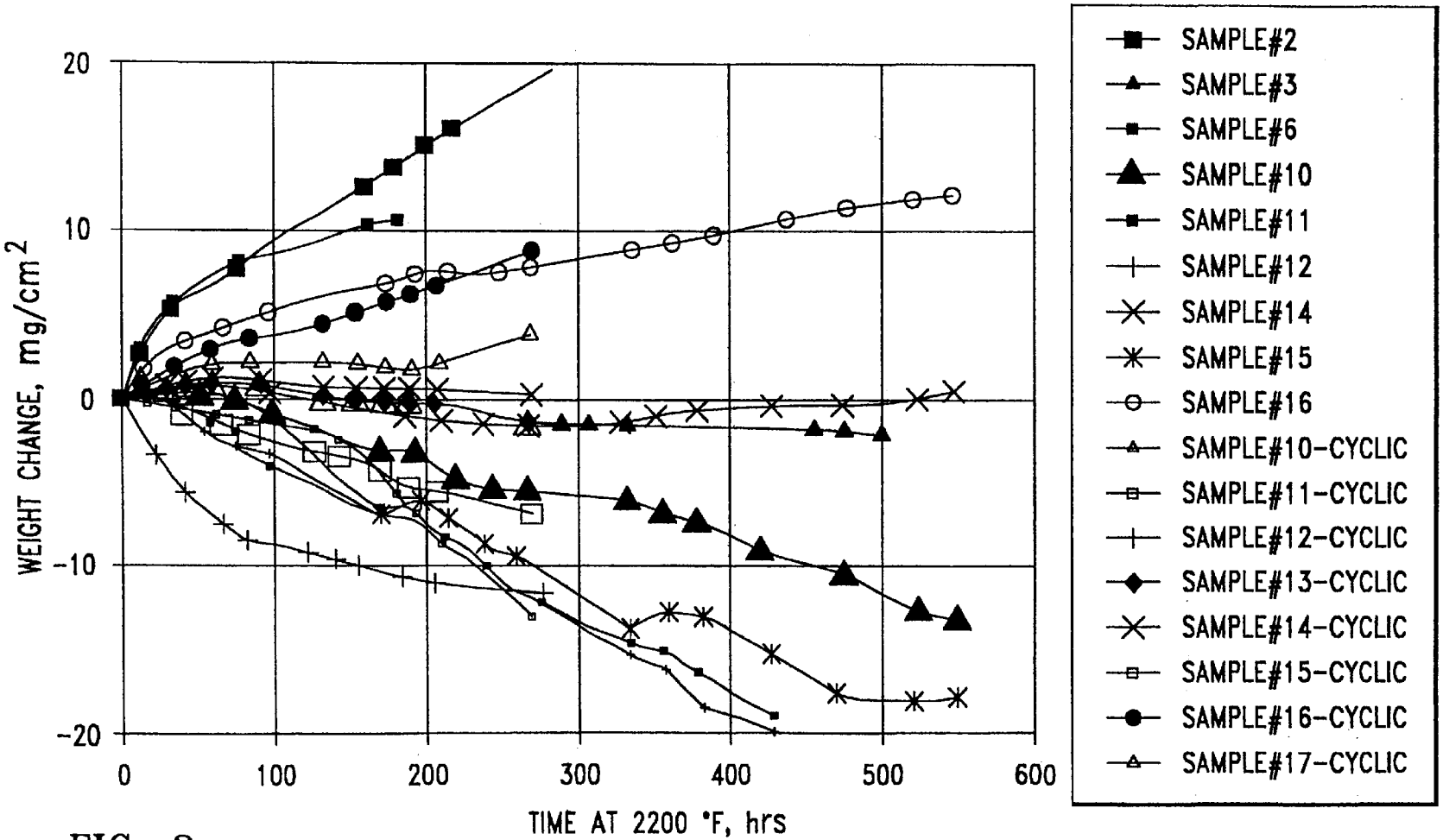
FIG. 2 is a graph similar to that of FIG. 1, utilizing a more specific range for y-axis values (weight change measurements).

FIGS. 1 and 2 are graphs of weight change as a function of heat exposure. (FIG. 2 focuses on a narrower y-axis range). Curves which are closest to zero-weight-change are indicative of optimum oxidation resistance. Curves which increase with a greater weight change over exposure time are indicative of a decreased level of oxidation resistance. Curves which show a negative weight change over exposure time are indicative of a coating in which an overlying TGO is spalling. Coatings with limited amounts of TGO spallation can still be very useful in certain end use applications.

As shown in the tables, some of the samples were subjected to a thermal cycling regimen (i.e., "cyclic" on the graph key). These samples were brought up to a temperature of 2200° F. (1204° C.), held for 50 minutes; cooled for 10 minutes, and then again heated to 1204° C., to continue the cycle. The exposure time for these samples represents the accumulated time over a number of cycles.

Sample 3, which included the addition of tantalum and molybdenum, exhibited much better oxidation resistance than samples 2 and 9. This oxidation resistance was achieved, even in the presence of a relatively small level of aluminum (38 atom %). As discussed above, the lower levels of aluminum are preferred in certain embodiments in which extensive interdiffusion between the coating and the substrate could be detrimental.

Sample 13, which included zirconium, tantalum, chromium, and a higher level of aluminum (50 atom %), exhibited excellent oxidation resistance, even in the absence of a precious metal. Sample 14, which included 8 atom % platinum, 38 atom % aluminum, 1 atom % tantalum, 5 atom % chromium, 0.2 atom % zirconium, the balance nickel, also exhibited excellent oxidation resistance.

A regression analysis of oxidation resistance data was also carried out. A comparison of a number of samples was made, including samples 2,3, and 9, for alloys containing various combinations of tantalum, tungsten, molybdenum, and rhenium. The analysis demonstrated that the presence of tantalum was a positive influence on oxidation resistance, as compared to the other elements.

Having described preferred embodiments of the present invention, alternative embodiments may become apparent to those skilled in the art, without departing from the spirit of this invention. Accordingly, it is understood that the scope of this invention is to be limited only by the appended claims.

What is claimed:

1. An oxidation-resistant coating, formed of an alloy comprising:

about 40 to about 50 atom % aluminum; and about 0.5 atom % to about 3 atom % tantalum;

with the balance comprising at least one base metal selected from the group consisting of nickel, cobalt, iron, and combinations thereof.

2. The coating of claim 1, wherein the tantalum is present at a level in the range of about 0.5 atom % to about 2 atom %.

3. The coating of claim 2, wherein the tantalum is present at a level in the range of about 0.75 atom % to about 1.75 atom %.

4. The coating of claim 1, wherein the alloy further comprises a precious metal selected from the group consisting of platinum, palladium, iridium, rhodium, ruthenium, and mixtures thereof.

5. The coating of claim 4, wherein the precious metal is platinum, and is present at a level in the range of about 1 atom % to about 10 atom %.

6. The coating of claim 4, wherein the precious metal is palladium, ruthenium, iridium, rhodium, or mixtures thereof, and is present at a level in the range of about 1 atom % to about 30 atom %.

7. The coating of claim 1, further comprising at least one component selected from the group consisting of zirconium, titanium, hafnium, silicon, boron, carbon, and yttrium.

8. The coating of claim 1, further comprising molybdenum.

9. The coating of claim 1, wherein at least a portion of the base metal is obtained from an underlying substrate by way of diffusion.

10. The coating of claim 1, further comprising about 1 atom % to about 15 atom % chromium.

11. The coating of claim 10, wherein the level of chromium is in the range of about 1 atom % to about 10 atom %.

12. The coating of claim 10, wherein at least a portion of the chromium is obtained from an underlying substrate by way of diffusion.

13. The coating of claim 10, wherein the tantalum is present at a level in the range of about 0.5 atom % to about 2 atom %.

14. The coating of claim 10, wherein the alloy further comprises a precious metal selected from the group consisting of platinum, palladium, iridium, rhodium, ruthenium, and mixtures thereof.

15. The coating of claim 14, wherein the precious metal is platinum, and is present at a level in the range of about 1 atom % to about 10 atom %.

16. The coating of claim 14, wherein the precious metal is palladium, ruthenium, iridium, rhodium, or mixtures thereof, and is present at a level in the range of about 1 atom % to about 30 atom %.

17. The coating of claim 10, further comprising at least one component selected from the group consisting of zirconium, titanium, hafnium, silicon, carbon, boron, and yttrium.

18. The coating of claim 17, wherein the total amount of zirconium, titanium, hafnium, silicon, carbon, boron, and yttrium is in the range of about 0.1 atom % to about 5 atom %.

19. The coating of claim 18, wherein the total amount of zirconium, titanium, hafnium, silicon, carbon, boron, and yttrium is in the range of about 0.4 atom % to about 2.5 atom %.

20. The coating of claim 17, wherein the zirconium is present at a level in the range of about 0.1 atom % to about 1 atom %.

21. The coating of claim 17, wherein the component is a mixture of zirconium and hafnium.

22. The coating of claim 10, further comprising about 0.2 atom % to about 2 atom % molybdenum.

23. The coating of claim 22, further comprising about 0.5 atom % to about 2 atom % tantalum.

24. An oxidation-resistant coating, formed of an alloy comprising:

about 40 to about 50 atom % aluminum;

about 0.5 atom % to about 3 atom % tantalum;

about 1 atom % to about 15 atom % chromium; and about 0.1 atom % to about 1 atom % zirconium;

with the balance comprising at least one base metal selected from the group consisting of nickel and nickel-cobalt.

25. The coating of claim 24, wherein the alloy further comprises a precious metal.

26. The coating of claim 25, wherein the precious metal is platinum, and is present at a level in the range of about 1 atom % to about 10 atom %.

27. An oxidation-resistant coating, formed of an alloy comprising:

about 40 to about 50 atom % aluminum;

about 0.5 atom % to about 3 atom % tantalum;

about 1 atom % to about 15 atom % chromium; and about 0.2 atom % to about 2.0 atom % molybdenum;

with the balance comprising at least one base metal selected from the group consisting of nickel and nickel-cobalt.

28. The coating of claim 27, further comprising at least one precious metal.

29. A method for providing environmental protection to a metal-based substrate, comprising the step of forming a coating on the substrate, wherein the coating has an alloy composition which comprises:

about 40 to about 50 atom % aluminum; and about 0.5 atom % to about 3 atom % tantalum;

with the balance comprising a base metal selected from the group consisting of nickel, cobalt, iron, and combinations thereof.

30. The method of claim 29, wherein at least a portion of the base metal is obtained from the substrate, by way of diffusion.

31. The method of claim 29, wherein the alloy further comprises about 1 atom % to about 15 atom % chromium.

32. The method of claim 31, wherein at least a portion of the chromium is obtained from an underlying substrate by way of diffusion.

33. The method of claim 29, wherein the alloy further comprises a precious metal selected from the group consisting of platinum, palladium, iridium, rhodium, ruthenium, and mixtures thereof.

34. The method of claim 29, wherein the alloy further comprises at least one component selected from the group consisting of zirconium, titanium, hafnium, silicon, carbon, boron, and yttrium.

35. The method of claim 29, further comprising about 0.2 atom % to about 2.0 atom % molybdenum.

36. The method of claim 29, wherein the metal-based substrate is a superalloy.

37. An article, comprising:

(i) a metal-based substrate; and (ii) an oxidation-resistant coating over the substrate, formed of an alloy comprising:
about 40 to about 50 atom % aluminum; and
about 0.5 atom % to about 3 atom % tantalum;
with the balance comprising nickel, cobalt, iron, or combinations thereof.

38. The article of claim 37, wherein the alloy further comprises about 1 atom % to about 15 atom % chromium.

39. The article of claim 37, wherein the alloy further comprises a precious metal selected from the group consisting of platinum, palladium, iridium, rhodium, ruthenium, and mixtures thereof.

40. The article of claim 37, wherein the alloy further comprises at least one component selected from the group consisting of zirconium, titanium, hafnium, silicon, carbon, boron, and yttrium.

41. The article of claim 37, further comprising about 0.2 atom % to about 2 atom % molybdenum.

42. The article of claim 37, further comprising a thermal barrier coating disposed over the oxidation-resistant coating.

43. The article of claim 42, wherein the thermal barrier coating comprises zirconia.

44. The article of claim 37, wherein the metal-based substrate is a superalloy.

45. The article of claim 37, wherein the metal-based substrate is a component of a turbine engine.

* * * * *